US006991689B2

(12) United States Patent
Vine et al.

(10) Patent No.: US 6,991,689 B2
(45) Date of Patent: Jan. 31, 2006

(54) ALUMINIUM-LITHIUM ALLOYS

(75) Inventors: Wendy J Vine, Farnborough (GB); Donald S McDarmaid, Farnborough (GB); Christopher J Peel, Farnborough (GB)

(73) Assignee: Qinetiq Limited, London (GB)

( * ) Notice: Subject to any disclaimer, the term of this patent is extended or adjusted under 35 U.S.C. 154(b) by 0 days.

(21) Appl. No.: 10/397,246

(22) Filed: Mar. 27, 2003

(65) Prior Publication Data

US 2003/0202900 A1 Oct. 30, 2003

Related U.S. Application Data

(62) Division of application No. 09/367,597, filed as application No. PCT/GB98/00419 on Feb. 11, 1998, now abandoned.

(30) Foreign Application Priority Data

Jul. 19, 1997 (GB) ..... 9715159
Feb. 24, 1998 (GB) ..... 9703820

(51) Int. Cl.
*C22F 1/057* (2006.01)
*C22F 1/04* (2006.01)

(52) U.S. Cl. ..... 148/693; 148/694; 148/700

(58) Field of Classification Search ..... 148/693, 148/697, 700, 417, 418, 694; 420/533
See application file for complete search history.

(56) References Cited

U.S. PATENT DOCUMENTS 4,806,174 A * 2/1989 Cho et al. ..... 148/693
4,840,683 A 6/1989 Dubost
5,066,342 A 11/1991 Rioja et al.

FOREIGN PATENT DOCUMENTS

EP 0 088 511 9/1983
JP 61-023751 2/1986
WO WO 91 08319 6/1991

OTHER PUBLICATIONS

"Aluminum and Aluminum Alloys", ASM International (1993), p 247-248.*
Patent Abstracts of Japan, vol. 010, No. 172, Jun. 18, 1986 & JP 61 023751 A, Feb. 1, 1986.
Patent Abstracts of Japan, vol. 015, No. 064, Feb. 15, 1991 & JP 02 290952, Nov. 30, 1990.

* cited by examiner

*Primary Examiner*—George Wyszomierski
*Assistant Examiner*—Janelle Morillo
(74) *Attorney, Agent, or Firm*—Nixon & Vanderhye P.C.

(57) ABSTRACT

An aluminum based alloy having a composition within the following ranges, all of the ranges being in weight percent: lithium 2.0 to 2.8, magnesium 0.4 to 1.0, copper 2.0 to 3.0, manganese 0.7 to 1.2, zirconium up to 0.2 and the balance aluminum, save for incidental impurities and up to 2.0 in total of one or more grain controlling elements to provide microstructural optimization and control.

2 Claims, 4 Drawing Sheets

ALUMINIUM-LITHIUM ALLOYS

Figure 1A:
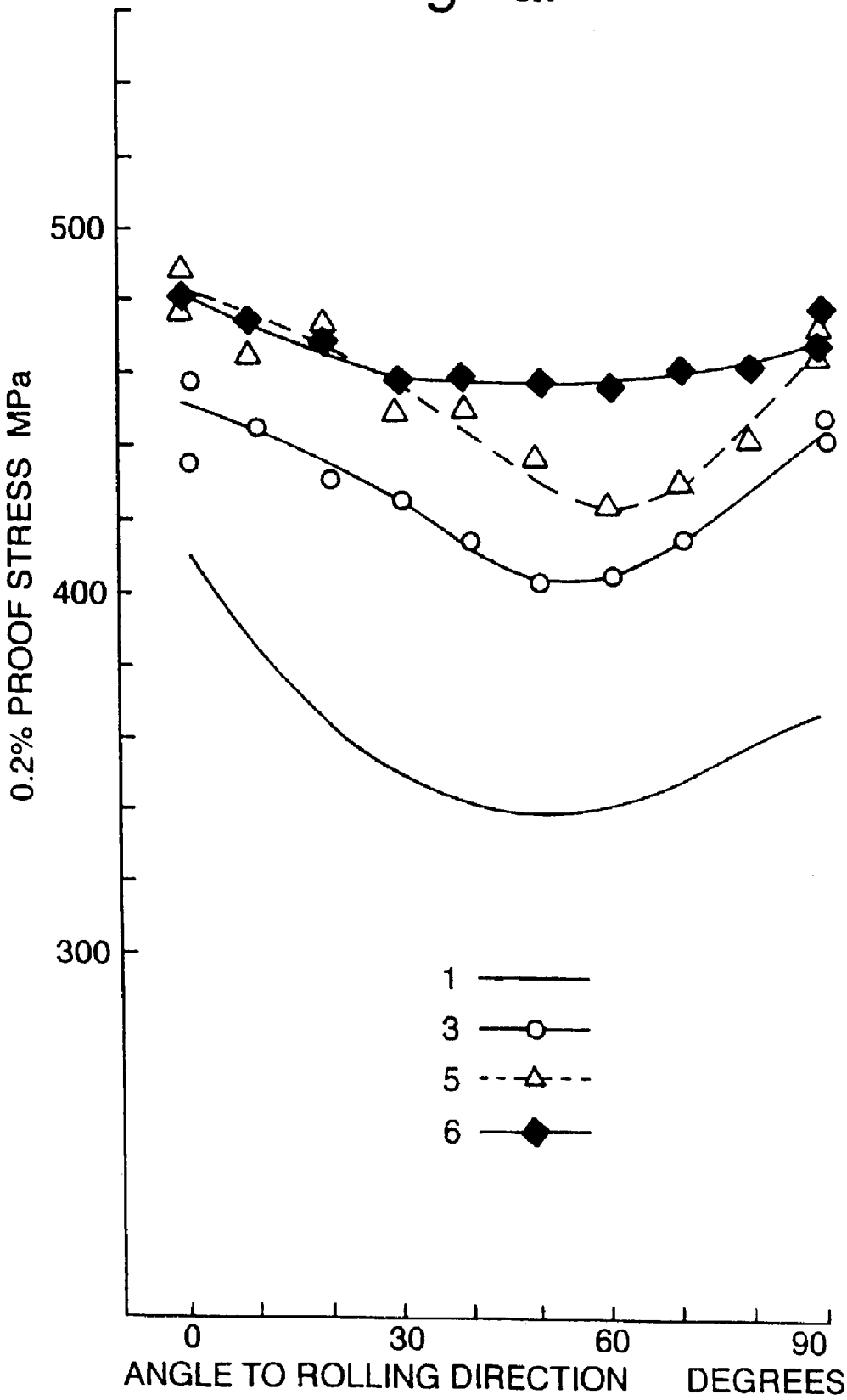

This application is a division of application Ser. No. 09/367,597, filed Aug. 18, 1999, now abandoned which in turn is a §371 of PCT/GB98/00419 filed Feb. 11, 1998, the entire content of which is hereby incorporated by reference in this application.

The invention relates to high-strength aluminium-lithium alloys and in particular to those alloys suitable for fabrication into high-strength plate materials for aerospace applications.

It is known that addition of lithium to aluminium alloys reduces density and increases elastic modulus to produce a significant increase in specific stiffness, and produces an alloy system which is amenable to precipitation hardening. Aluminium-lithium based alloys are becoming established as lightweight alternatives to conventional aluminium alloys in weight critical applications, such as for aerospace construction.

For many aerospace applications emphasis has been placed upon materials containing 2–3 wt % lithium, especially alloys of the Al—Li—Cu—Mg system and in particular alloys of the Al—Li—Cu—Mg—Zr system such as are disclosed in United Kingdom Patent 2115836 and defined in the 8090 standard specification. Although zirconium is introduced into these alloys as a cast grain refiner it also forms dispersoids of $Al_3Zr$ (β') intermetallic phase, which are non-shearable, and inhibit the recrystallization processes. Material with the resultant unrecrystallised grain structure suffers from significant tensile property anisotropy due to the retention of the (110) <112> hot deformation texture, and subsequently the recrystallization textures derived from it. The resultant reduction in 0.2% proof stress. and tensile strength at intermediate angles to the rolling direction reduces the overall useable strength of the material to well below its potential.

As a result it can be necessary for strength critical applications to use higher strength alloys such as the Al—Zn—Mg 7XXX series alloys which do not offer the same advantages of light weight. Although the type of tensile anisotropy discussed above also exists in these alloys, it is less restricting in high strength designs because of the inherently higher strength of the 7XXX series materials. The potential for appreciable weight saving could be offered if the tensile anisotropy exhibited by alloys of the Al—Li—Cu—Mg system was reduced to address the problem of reduced "off-angle" strength levels in such alloys to a degree where off-angle strength levels were comparable with those typical of the minimum off-angle tensile performance of conventional aluminium 7XXX series alloy plate.

The present invention is directed towards the provision of a high-strength aluminium-lithium alloy material based on the Al—Li—Cu—Mg system which mitigates some or all of the above problems whilst maintaining low density and in particular which exhibits reduced tensile strength anisotropy in comparison with conventional Al—Li—Cu—Mg—Zr alloys.

According to the invention, an aluminium based alloy has a composition within the following ranges, all of the ranges being in weight percent:

lithium 2.0 to 2.8, magnesium 0.4 to 1.0, copper 2.0 to 3.0, manganese 0.7 to 1.2, zirconium up to 0.2 and the balance, save for incidental impurities and up to 2.0 in total of one or more further grain controlling elements to provide microstructural optimisation and control, aluminium.

The principal alloying elements are lithium, magnesium, copper and manganese, with zirconium optionally present at up to 0.2 weight percent and further optional additions of one or more other elements selected from those established in the art as suitable for the optimisation and control of the recrystallised microstructure (as precipitate formers and elements controlling grain size and grain growth on recrystallization) up to a maximum of 2.0 weight percent in total. Preferably, these further grain controlling elements are selected from scandium, titanium, vanadium and niobium at up to 0.2 weight percent, nickel and chromium, at up to 0.5 weight percent and preferably at up to 0.2 weight percent, hafnium at up to 0.6 weight percent, and cerium at up to 0.5 weight percent.

Alloys in accordance with the invention are found to exhibit improved tensile performance and in particular decreased tensile property anisotropy in comparison with the marked tensile property anisotropy exhibited by conventional Al—Li—Cu—Mg—Zr alloys, whilst retaining adequate base line strength.

Whilst the invention is not limited by any particular theory, it is believed that the role of manganese in alloys in accordance with the invention in forming precipitate dispersions is a significant determining factor in the tensile properties of the alloy, and in producing the improved properties when compared with conventional alloys of the 8090 type. Minimum manganese levels in alloys in accordance with the invention are significantly higher than the 8090 specification maximum of 0.5 weight percent.

Manganese exhibits only limited solid solubility in the Al—Li matrix, and reaction with the other alloying elements provide particles of three different intermetallic phases that assist strengthening mechanisms either directly or indirectly. $Al_6Mn/Al_6(Mn,Fe)$ forms as coarse particles (of >1 μm diameter) which assist the recrystallization processes and thus produce the required tensile isotropy; however such particles do not implicitly strengthen the material. Although 8090 alloy contains coarse constituent particles, these phases are deleterious since they assume needle shaped morphologies and act as stress concentration sites; alloys in accordance with the invention feature predominantly rounded $Al_6Mn/Al_6(Mn,Fe)$ constituent particles which are much less damaging to the microstructure.

Al—Cu—Mn orthorhombic phases ($Al_{20}Cu_2Mn_3$ and $Al_{12}CuMn_3$) form as fine particles (of length less than 1 μm and a length: diameter ratio of about 5) which are homogeneously distributed throughout the matrix. These fine particles, which neither pin sub-grain boundaries nor promote recrystallisation, may represent ≦5 vol % of the alloy and facilitate slip dispersion and thus strengthen the alloy beyond the level attained by Mn-free Al—Li—Cu—Mg alloys of otherwise comparable matrix composition.

The Al—Cu—Mn particles indirectly strengthen the alloy by introduction of dislocation networks (without recourse to cold-working) on account of the mismatch of intermetallic and matrix thermal expansion coefficients (CTE). The dislocations provide a high density of nucleation sites for precipitation of highly desirable age hardening phases, such as S' ($Al_2CuMg$) and $T_1$ ($Al_2CuLi$).

At these manganese levels, raising the copper content above the levels found in typical prior art alloys such as a standard 8090 alloy is associated initially with an increase in the brass component to reach a maximum at around 1.7 wt % Cu, thereby producing a preferred grain orientation, and hence anisotropic, microstructure. However levels of around 2.0 weight percent of copper (in accordance with the present invention) are associated with an unexpected recovery of the cube and reduction in the brass components respectively and an increasingly recrystallised microstructure is observed which is more or less complete by 2.5 weight percent of copper; this produces increased tensile isotropy.

To enhance the effect of the alloying additions and in particular the reduction of anisotropy the alloy preferably comprises at least 0.9 and more preferably at least 1.0 weight percent manganese. It is further preferred that the copper: manganese ratio in the alloy is in the range 2.4 to 2.6. An upper limit on levels of copper and manganese is imposed by weight requirements and alloys having copper levels above 3.0 weight percent and manganese levels above 1.2 weight percent are not considered practical.

The alloy preferably comprises at least 0.02 weight percent of zirconium as the preferred alloying addition for microstructural optimisation control and preferably at least 0.02 weight percent of one or more of the further grain controlling elements. Addition of zirconium to alloys within the composition ranges in accordance with the invention is associated with improved tensile performance but increased anisotropy.

Where reduced anisotropy is critical to the application of the alloy. zirconium should be kept at less than 0.06 weight percent, and may be omitted. Higher levels of up to 0.2 weight percent produce greater strength alloys.

For alloys in accordance with the invention to be viable as lighter weight alternatives to 7XXX series aluminium alloy for high strength, an alloy with nominally isotropic tensile properties is particularly preferred and the alloy should at least exhibit a reduction in anisotropy to a degree where off-angle strength levels were comparable with those typical of the minimum off-angle tensile performance of conventional aluminium 7XXX series alloy plate, say 0.2% proof stress (0.2% PS) 450 MPa and tensile strength (TS) 500 MPa.

Examples of alloys in accordance with the present invention will now be given, alongside examples of alloys in the Al—Li—Cu—Mg system falling outside the invention for the purposes of comparison, together with properties and heat treatment data.

Improved tensile performance has been demonstrated for plate and sheet alloy products, though the alloy is not in any way theoretically limited to these specific products, and these product are given for example purposes only.

Alloys according to the invention can be prepared as plate products. The alloy is thermomechanically processed (by forging and hot-rolling) to the desired plate thickness before solution heat treatment in air, followed by cold water quench (CWQ) and optional subsequent stretch, maintaining a quench delay of under 2 hours. Alloy plate is finally artificially aged, to the desired temper. The examples are listed in Table 1.

TABLE 1

Example of Al—Li—Cu—Mg Alloys

| | Major alloying elements (wt %) | | | |
|---|---|---|---|---|
| example | Li | Cu | Mg | Mn |
| 1 | 2.46 | 1.19 | 0.76 | 0.55 |
| 2 | 2.46 | 1.21 | 0.77 | 0.78 |
| 3 | 2.46 | 1.51 | 0.82 | 1.06 |
| 4 | 2.40 | 1.67 | 0.78 | 1.02 |
| 5 | 2.28 | 1.99 | 0.78 | 1.02 |
| 6 | 2.42 | 2.45 | 0.79 | 1.07 |

Of the alloys given in the examples, 1 is illustrative of a conventional prior art Al—Li—Cu—Mg alloy, 2 is illustrative of the effect of raising manganese levels, 3 and 4 are illustrative of the effect of raising copper content in high manganese alloys to levels intermediate between those in conventional 8090 alloys and those in alloys in accordance with the invention, and 5 and 6 are examples of the invention.

Tensile test pieces with their tensile axis varying at 10° intervals between 0° and 90° to the rolling direction were studied according to BS18 (19.87) Cat 2. The results of these tests are portrayed in FIG. 1 (which compares several of the example alloys both in accordance with and outside the ranges of the present invention) and in FIG. 2 (which compares alloy example 7 with various convention prior art alloys).

Figure 1B:
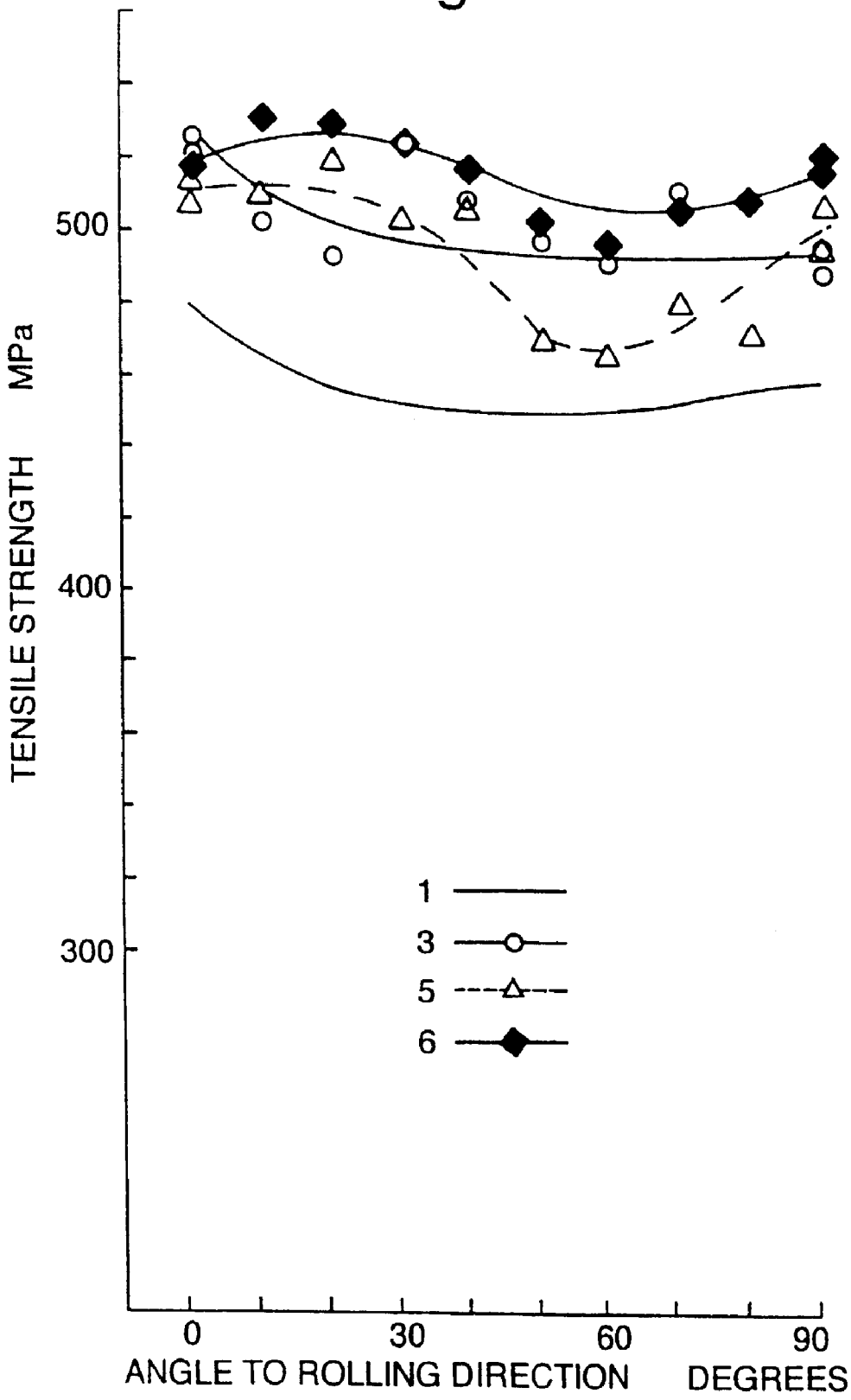

FIGS. 1*a* shows the effect of test orientation on 0.2% proof stress and 1*b* the effect of test orientation on UTS comparing examples 1, 3, 5 and 6. It is illustrated that at the copper and manganese levels of examples 1 and 3 which fall outside the invention, strength levels are low. At copper levels of example 5 an appreciable degree of anisotropy is still shown, but base-line strength has been significantly raised to mitigate this, and at the levels of example 6 a substantial degree of isotropy is achieved with good baseline strength.

Figure 2A:
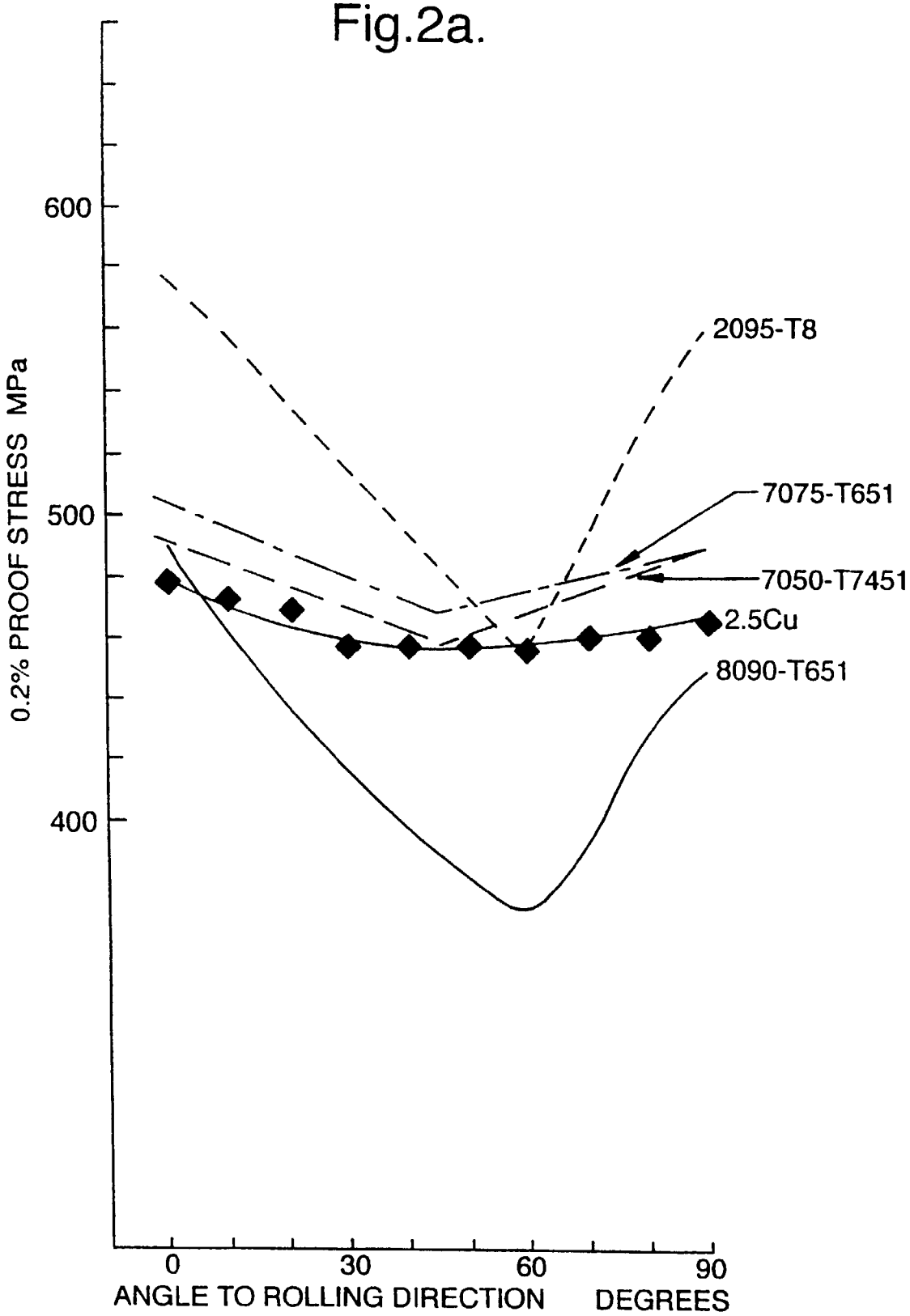
Figure 2B:
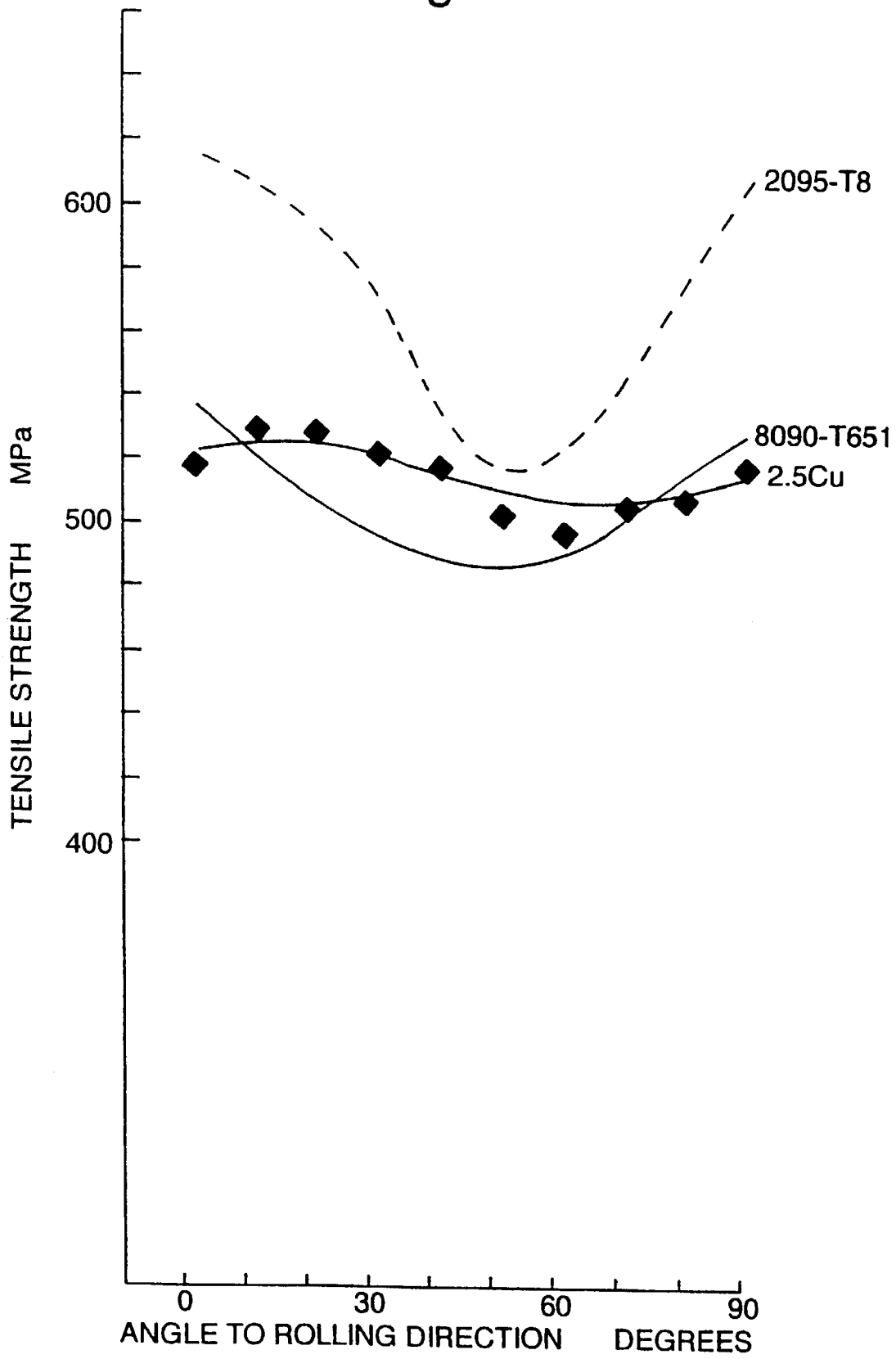

FIGS. 2*a* (0.2% proof stress data) and 2*b* (UTS data) illustrate that example 6 achieved substantial degree of isotropy in comparison with many conventional alloys, and with 8090 in particular. Off-angle performance well in excess of 8090 and comparable with alloys of the 7XXX series and even with the off-angle minimum of the high-strength alloy 2095 are achieved. Although there is some density penalty with respect to 8090 the plate of example 6 is 8% lighter and 10% stiffer than conventional 7XXX series plate at comparable strength levels and 5% lighter than 2095 of comparable minimum useable strength levels.

Plates of the invention composition aged to the -T651 condition thus demonstrate proof stresses at intermediate angles between L and LT directions in excess of 460 MPa; i.e. the baseline proof stress is 460 MPa, whereas that of 8090-T651 is just 360 MPa.

This performance is comparable to 7050-T7451 and 7075-T651 alloys, which are approximately 10% more dense than a typical alloy according to the invention. While the anisotropic 2095-T8 exhibits higher yield stress in L and LT directions, the maximum usable stress (defined by the minimum proof stress measured at an intermediate angle between L and LT directions) is comparable (~460 MPa).

Optical microscopy and TEM were used to examine the microstructure of the examples, the results being summarised on table 2. The crystallographic texture of each material was determined using incomplete (111), (200) and (220) pole figures with a maximum tilt angle of 85°. The results of the crystallographic texture analysis are also set out in table 2.

TABLE 2

Analysis of crystallographic texture for the example plates

| example | strength of brass component (110)<112> x random | strength of cube component (100)<001> x random | grain structure |
|---|---|---|---|
| 1 | 5.0 | 31.3 | recrystallised |
| 2 | — | 30.8 | recrystallised |

TABLE 2-continued

Analysis of crystallographic texture for the example plates

| example | strength of brass component (110)<112> x random | strength of cube component (100)<001> x random | grain structure |
|---|---|---|---|
| 3 | 20.4 | — | mixed |
| 4 | 94.2 | — | unrecrystallised |
| 5 | 27.1 | 17.0 | mixed |
| 6 | — | 18.2 | recrystallised |

It has been demonstrated that the variation in number density of both large constituent and small Al—Cu—Mn particles with both Mn and Cu content; the balance between these phases critically defines the plate grain structure. As the table illustrates low manganese alloys (1, 2) exhibit a significant cube (recrystallised) texture component which is believed to be caused by the presence of large constituent particles, providing particle stimulated nuclei (PSN) sites for recrystallisation.

As manganese content increases (3) the volume fraction of Al—Cu—Mn is increased at the expense of the large constituent particles with resultant effect on this balance of phases and likely increase in the level of anisotropy. The deformation zones surrounding Al—Cu—Mn particles are smaller and initiation of recrystallization from these particles is energetically unfavourable (i.e. Al—Cu—Mn particles are not PSN sites). It is suggested that dominance of unrecrystallised texture components in higher manganese alloys results from a deficit of coarse constituent particles, required to act as PSNs. Manganese addition appears to reduce the constituent particle density by removing Cu from the alloy when Al—Cu—Mn nucleates and grows.

However although tensile isotropy is most closely satisfied by recrystallised low manganese plate its baseline strength is unsatisfactory (for L direction, 0.2% PS-340 MPa, UTS=415 MPa.) and such alloys are not viable choices for high strength application.

The tendency for an increase in the copper content to produce an initial increase in the brass component, to reach a maximum at 1.7 wt % Cu, is illustrated by example 4. This alloy produced the most unrecrystallised—and hence anisotropic—plate of the example. For copper concentrations in excess of 1.7 wt %, the cube texture is recovered and the brass component simultaneously reduced. This results in a recrystallised grain structure, having isotropic tensile properties (in plane) as is illustrated in examples 6 and 7.

Sheet products of the invention alloy are produced from billet by standard procedure, including forging, hot and cold-rolling to the desired thickness, implementing >30% reduction. Fine recrystallised grain structures, that are essential for tensile isotropy, can be produced by SHT in either air or salt bath (followed) by CWQ. This offers an advantage over 8090 alloy sheet, which may recrystallize on salt bath SHT. An optional stretch can be applied, after SHT but maintaining a quench delay of less than 2 hours, prior to artificial ageing to the desired temper.

Homogeneous distributions of sub-micron scale Al—Cu—Mn intermetallic phases in the sheet material both strengthen the alloy and provide a high density of dislocations that are preferential nucleation sites for age hardening precipitates.

What is claimed is:

1. A method of producing an aluminum based alloy sheet or plate product, wherein the sheet or plate product is produced directly by a standard procedure consisting of the steps of:

a) forging and/or hot rolling to be the desired thickness;

b) solution heat treatment;

c) quenching;

d) optional stretching; and, e) age hardening to the desired temper, wherein the alloy consists essentially of a composition within the following ranges, all of the ranges being specified in weight percent:

| | |
|---|---|
| lithium | 2.0 to 2.8; |
| magnesium | 0.4 to less than 1.0; |
| copper | 2.4 to 3.0; |
| manganese | 0.1 to 1.2; |
| zirconium | up to 0.2; |
| grain controlling elements | up to 2.0; and |
| aluminum | balance, |

and further, wherein the sheet or plate product contains homogeneous distributions of sub-micron scale Al—Cu—Mn intermetallic phases in the sheet product that improve strength and hardness.

2. A method of producing an aluminum based alloy sheet or plate product, wherein the sheet or plate product is produced directly by a standard procedure consisting of the steps of:

a) forging and/or hot rolling to be the desired thickness;

b) solution heat treatment;

c) quenching;

d) optional stretching; and, e) age hardening to the desired temper, wherein the alloy consists essentially of a composition within the following ranges, all of the ranges being specified in weight percent:

| | |
|---|---|
| lithium | 2.0 to 2.8; |
| magnesium | 0.4 to less than 1.0; |
| copper | 2.4 to 3.0; |
| manganese | 1.0 to 1.2; |
| zirconium | up to 0.2; |
| grain controlling elements | up to 2.0; and, |
| aluminum | balance, |

and further, wherein the sheet or plate product exhibits reduced tensile strength anisotropy with a minimum off axis 0.2% proof stress in excess of 450 MPa.

* * * * *

UNITED STATES PATENT AND TRADEMARK OFFICE

CERTIFICATE OF CORRECTION

PATENT NO. : 6,991,689 B2
APPLICATION NO. : 10/397246
DATED : January 31, 2006
INVENTOR(S) : Vine et al.

It is certified that error appears in the above-identified patent and that said Letters Patent is hereby corrected as shown below:

On Title Page Item (30) Foreign Application Priority Data Please add

Feb. 24, 1997 (GB) 9703820.2

Jul. 19, 1997 (GB) 9715159.1

Signed and Sealed this

Fifth Day of February, 2008

JON W. DUDAS
*Director of the United States Patent and Trademark Office*